US005448794A

United States Patent [19]

Walch et al.

[11] Patent Number: 5,448,794

[45] Date of Patent: Sep. 12, 1995

[54] CORDED HANDHELD VACUUM CLEANER

[75] Inventors: John W. Walch, Abingdon, Va.; Dennis J. Mancl, Bluff City, Tenn.

[73] Assignee: Electrolux Corporation, Atlanta, Ga.

[21] Appl. No.: 122,149

[22] Filed: Sep. 16, 1993

[51] Int. Cl.[6] ..... A47L 5/00

[52] U.S. Cl. ..... 15/326; 15/344; 15/392; 15/412

[58] Field of Search ..... 15/326, 344, 363, 377, 15/383, 392, 412

[56] References Cited

U.S. PATENT DOCUMENTS

| | | | |
|---|---|---|---|
| 2,491,007 | 12/1949 | Koch | 15/344 |
| 2,633,597 | 4/1953 | Turner | 15/383 |
| 3,060,485 | 10/1962 | Butter | 15/344 |
| 3,368,231 | 2/1968 | Kravos | 15/344 |
| 3,592,566 | 7/1971 | Beardslee | 417/423 |
| 3,597,789 | 8/1971 | Boyd | 15/383 |
| 3,634,905 | 1/1972 | Boyd | 15/350 |
| 3,654,661 | 4/1972 | Scott | 15/333 |
| 4,011,624 | 3/1977 | Proett | 15/344 |
| 4,041,568 | 8/1977 | Rhodes | 15/344 |
| 4,120,616 | 10/1978 | Dwyer | 15/344 |
| 4,123,818 | 11/1978 | Hurwitz | 15/321 |
| 4,292,706 | 10/1981 | Fortune | 15/341 |
| 4,329,756 | 5/1982 | Chicoine et al. | 15/321 |
| 4,334,336 | 6/1982 | Harbeck et al. | 15/322 |
| 4,357,730 | 11/1982 | Lex | 15/344 |
| 4,380,845 | 4/1983 | Miller et al. | 15/344 |
| 4,513,470 | 4/1985 | Toya | 15/328 |
| 4,536,914 | 8/1985 | Levine | 15/344 |
| 4,542,557 | 9/1985 | Levine | 15/344 |
| 4,573,234 | 3/1986 | Kochte et al. | 15/323 |
| 4,573,237 | 3/1986 | Kochte et al. | 15/344 |
| 4,597,131 | 7/1986 | Lyman | 15/412 |
| 4,601,735 | 7/1986 | Morton, Jr. | 55/377 |
| 4,632,642 | 12/1986 | Meister | 15/412 |
| 4,633,543 | 1/1987 | Sovis et al. | 15/344 |
| 4,642,841 | 2/1987 | Berfield et al. | 15/330 |
| 4,670,701 | 6/1987 | Sako et al. | 320/2 |
| 4,682,384 | 7/1987 | Prahl et al. | 15/344 |
| 4,730,362 | 3/1988 | Sovis et al. | 15/339 |
| 4,741,070 | 5/1988 | Sovis et al. | 15/344 |
| 4,788,740 | 12/1988 | Sovis et al. | 15/339 |
| 4,791,699 | 12/1988 | Sovis et al. | 15/344 |
| 4,800,614 | 1/1989 | Kopco et al. | 15/330 |
| 4,821,366 | 4/1989 | Levine | 15/344 |
| 4,831,685 | 5/1989 | Bosyj et al. | 15/344 |
| 4,841,594 | 6/1989 | Elson | 15/344 |
| 4,850,076 | 7/1989 | Ostroski et al. | 15/328 |
| 4,891,861 | 1/1990 | Sovis et al. | 15/344 |
| 4,918,347 | 4/1990 | Takaba | 310/179 |
| 4,918,781 | 4/1990 | Sovis et al. | 15/392 |
| 4,928,346 | 5/1990 | Elson et al. | 15/338 |
| 4,934,020 | 6/1990 | Jackson | 15/339 |
| 4,942,641 | 7/1990 | Gerker | 15/344 |

(List continued on next page.)

FOREIGN PATENT DOCUMENTS

| | | | |
|---|---|---|---|
| 277628 | 8/1988 | European Pat. Off. | 15/344 |

*Primary Examiner*—Timothy F. Simone
*Assistant Examiner*—Terrence R. Till
*Attorney, Agent, or Firm*—Fish & Neave; Jeffrey H. Ingerman; G. Victor Treyz

[57] ABSTRACT

A handheld vacuum cleaner is provided that has a motor mounted with the rotational axis of its shaft parallel to the rotational axis of the rotating brush. The vacuum cleaner motor has an end bell, which is attached to the motor stator, and which holds a motor shaft bearing. The end bell is secured to the vacuum housing with an elastomeric mounting ring to dampen motor vibrations. The need for most motor mounting hardware is eliminated, because the housing supports the motor stator directly. The intake orifice of the vacuum is shaped to lie in two distinct planes, so that flat cleaning surfaces do not obstruct the orifice. The shape of the intake also allows one to clean immediately adjacent to a vertical wall.

13 Claims, 11 Drawing Sheets

U.S. PATENT DOCUMENTS

| | | | |
|---|---|---|---|
| 4,951,348 | 8/1990 | Krasznai et al. | 15/414 |
| 4,955,106 | 9/1990 | Stein et al. | 15/335 |
| 4,961,765 | 10/1990 | Günne et al. | 55/367 |
| 4,995,137 | 2/1991 | Reichborn | 15/327.1 |
| 5,000,671 | 3/1991 | Nolte | 425/231 |
| 5,014,386 | 5/1991 | Worwag | 15/339 |
| 5,020,186 | 6/1991 | Lessig, III et al. | 15/339 |
| 5,023,973 | 6/1991 | Tsuchida et al. | 15/319 |
| 5,084,934 | 2/1992 | Lessig, III et al. | 15/325 |
| 5,092,015 | 3/1992 | Kosten et al. | 15/338 |
| 5,099,545 | 3/1992 | Krasznai et al. | 15/344 |
| 5,105,502 | 4/1992 | Takashima et al. | 15/319 |
| 5,105,505 | 4/1992 | Reed, Jr. | 15/344 |
| 5,115,538 | 5/1992 | Cochran et al. | 15/383 |
| 5,134,751 | 8/1992 | Reed, Jr. et al. | 15/344 |
| 5,136,750 | 8/1992 | Takashima et al. | 15/319 |
| 5,142,730 | 9/1992 | Braks et al. | 15/327 |
| 5,144,714 | 9/1992 | Mori et al. | 15/319 |
| 5,144,715 | 9/1992 | Matsuyo et al. | 15/319 |
| 5,165,140 | 11/1992 | Ide | 15/392 |

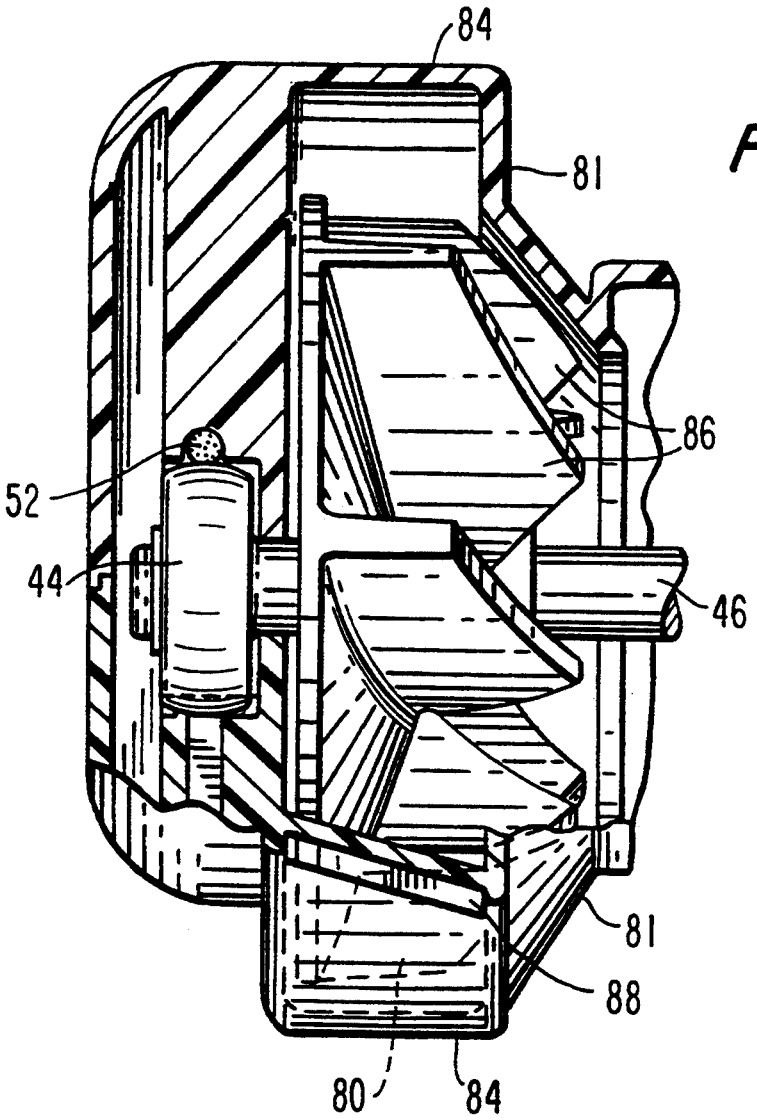
FIG. 14
FIG. 15
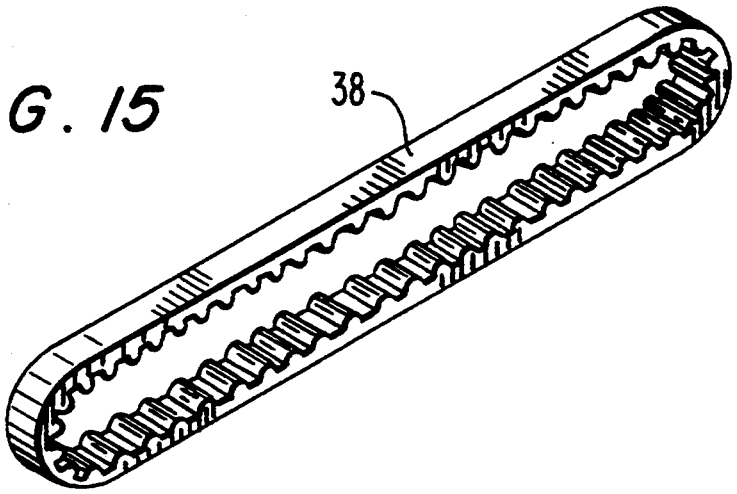

CORDED HANDHELD VACUUM CLEANER

BACKGROUND OF THE INVENTION

This invention relates to vacuum cleaners, and more particularly to corded handheld vacuum cleaners that have revolving brushes.

Corded handheld vacuum cleaners with revolving brushes are well-known. The electric motor for driving the brush is usually mounted with its rotational axis perpendicular to the rotational axis of the brush. However, this arrangement requires that the belt between the motor and brush be twisted, which increases wear of the belt. Further, such vacuum cleaners are generally rather bulky.

Motors are often secured using hardware such as motor mounting plates, which are attached to the vacuum cleaner housing. However, such mounting hardware is often so rigid that undesirable motor vibrations are transferred to the vacuum housing. Excessive mounting hardware can also increase the cost and complexity of a vacuum cleaner.

The belts typically used to drive the suction fan and the cooling fan also add to the complexity of many vacuum cleaners and may fail unexpectedly. Further, with many handheld vacuums the portion of the vacuum housing adjacent to the intake orifice is relatively flat, so that flat cleaning surfaces tend to obstruct the orifice and reduce the airflow through the vacuum. The intake orifice of conventional handheld vacuums is also often surrounded by a lip that can make it difficult or impossible to clean next to vertical surfaces.

It would therefore be desirable to be able to provide a vacuum cleaner in which the rotational axis of the motor lies parallel to the rotating brush axis so that the vacuum is more compact and thus lighter in weight than would otherwise be possible and so that it is not necessary to twist the belt that is used to drive the brush.

It would also be desirable to be able to eliminate unnecessary motor mounting hardware and reduce the effect of motor vibrations.

It would further be desirable to be able to place suction and cooling fans within a vacuum housing in such a way that the vacuum can be made more compact and thus lighter in weight than would otherwise be possible.

It would also be desirable to be able to provide a vacuum cleaner housing having an intake orifice that does not become obstructed when placed on a flat cleaning surface, and which is not encumbered by a lip surrounding the intake orifice, so that the vacuum can clean effectively adjacent to vertical surfaces.

It would also be desirable to be able to provide a vacuum cleaner housing having suction fan and exhaust chambers shaped to reduce noise and increase suction efficiency.

It would also be desirable to be able to provide a vacuum cleaner housing having deflection ribs in the vicinity of the rotating brush that deflect any dirt entering the vacuum cleaner intake orifice, so that such dirt is caught up in the air drawn into the vacuum cleaner, rather than being deflected back toward the intake orifice.

SUMMARY OF THE INVENTION

It is an object of the invention to provide a vacuum cleaner in which the rotational axis of the motor lies parallel to the rotating brush axis so that the vacuum is more compact than would otherwise be possible and so that it is not necessary to twist the belt that is used to drive the brush.

It is also an object of the invention to eliminate unnecessary motor mounting hardware and reduce the effect of motor vibrations.

It is a further object of the invention to place suction and cooling fans within a vacuum housing in such a way that the vacuum can be made more compact than would otherwise be possible.

It is also an object of the invention to provide a vacuum cleaner housing having an intake orifice that does not become obstructed when placed on a flat cleaning surface, and which is not encumbered by a lip surrounding the intake orifice, so that the vacuum can clean effectively adjacent to vertical surfaces.

It is also an object of the invention to provide a vacuum cleaner housing having suction fan and exhaust chambers shaped to reduce noise and increase suction efficiency.

It is also an object of the invention to provide a vacuum cleaner housing having deflection ribs in the vicinity of the rotating brush that deflect any dirt entering the vacuum cleaner intake orifice, so that such dirt is caught up in the air drawn into the vacuum cleaner, rather than being deflected back toward the intake orifice.

In accordance with this invention, a vacuum cleaner is provided that has a motor mounted with the rotational axis of its shaft parallel to the rotational axis of the rotating brush. This arrangement allows the vacuum to be compact and avoids the use of a twisted belt. The belt may have teeth so that it does not slip when driving the brush. The present design facilitates the use of a toothed belt, which would generally not be a preferred type of belt to use in the twisted belt configuration. Because the toothed belt does not slip, the rotational motion of the motor shaft is efficiently transferred to the brush.

The vacuum cleaner motor has an end bell, which is attached to the motor stator, and which holds a motor shaft bearing. The end bell is secured to the vacuum housing with a ribbed elastomeric mounting ring to dampen motor vibrations. The mounting ring ribs provide greater radial flex than would otherwise be available, so that greater variations in the sizes of the vacuum housing, end bell, and motor mounting ring can be tolerated. The need for most motor mounting hardware is eliminated, because the housing supports the motor stator directly.

The intake orifice of the vacuum is shaped to lie in two distinct planes, so that flat cleaning surfaces do not obstruct the orifice. Toward the rear of the vacuum cleaner the vacuum housing follows a first plane. In the front of the vacuum cleaner the housing follows a second plane. The planes define two distinct cleaning positions for the vacuum cleaner with respect to a flat cleaning surface. As the vacuum cleaner is moved forward, the user may place the vacuum cleaner in a position in which the first plane is aligned with the cleaning surface. On the return stroke, as the vacuum cleaner is moved backward, the user may position the vacuum cleaner so that the second plane is aligned with the cleaning surface. This arrangement supports a substantial flow of air, which carries dirt from the cleaning surface efficiently. The shape of the intake also allows one to clean immediately adjacent to a vertical wall.

Further, the cooling fan is arranged so that one motor bearing is located between the motor and the cooling fan. During operation, cooling air is supplied to the bearing, which is mounted in the motor end bell. Because the air passageway around the bearing that is mounted in the end bell is fairly small, the housing in which the motor is mounted has a gap that allows cooling air to flow freely from the vicinity of the motor, past the bearing mounted in the end bell, to an area surrounding the cooling fan.

The vacuum cleaner has a suction fan that is mounted on the motor shaft between the motor and one of the motor bearings. The placement of the suction fan between the bearing and the motor reduces vibrations, because the bearing supports the end of the motor shaft, which causes the shaft to wobble less than would otherwise be the case. Further, placing the bearing on the end of the shaft allows the suction fan to be placed closer to the center of the intake orifice, which allows air to flow more efficiently through the vacuum cleaner.

Adjacent to the vacuum cleaner intake there are deflection ribs, preferably formed integrally with the housing. The deflection ribs deflect dirt rotating with the brush, so that the deflected dirt is reentrained with the flow of air through the vacuum cleaner rather than being carried by the brush and ejected back through the intake orifice. The deflection ribs therefore improve the cleaning capability of the vacuum cleaner.

The vacuum cleaner has an exhaust chamber that is shaped in the form of a spiral. The suction fan is positioned in a suction fan chamber. A tongue is located between the suction fan chamber and the exhaust chamber at the point where the tips of the suction fan blades are closest to the spiral wall of the exhaust chamber. Preferably, the tongue and the tips of the suction fan blades are .angled with respect to one another, so that when the tips of the suction fan blades pass the tongue, the air between the tips of the suction fan blades and the tongue is compressed less forcefully than it would be if the tongue and suction fan blade tips were parallel. Because air compression by the suction fan blades generates noise, angling the tips of the suction fan blades and the tongue with respect to each other reduces the noise generated by the suction fan. The angle of tongue and the spiral shape of the exhaust chamber wall create a smooth interface between the suction fan chamber and the exhaust chamber, which also increases suction efficiency.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 14 is a cross-sectional view of a portion of the vacuum cleaner of FIG. 1 taken along the line 14—14 in FIG. 13; and FIG. 15 is a perspective view of a preferred embodiment of a toothed belt used to drive the dust brush in a preferred embodiment of the present invention.

DETAILED DESCRIPTION OF THE PREFERRED EMBODIMENTS

Figure 1:
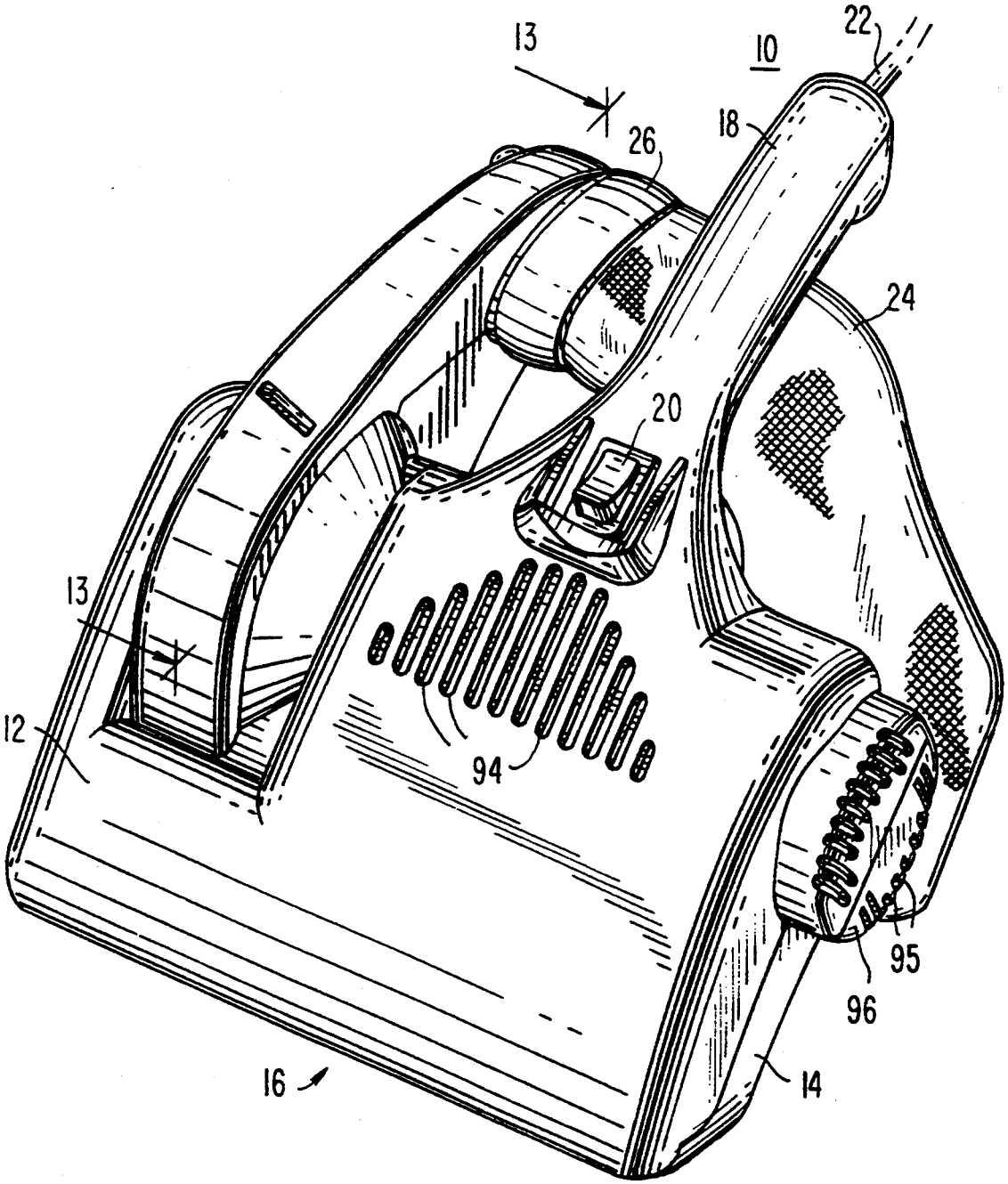
FIG. 1 is a perspective view of a preferred embodiment of a handheld vacuum cleaner in accordance with the present invention.

A handheld vacuum cleaner 10 constructed in accordance with the present invention is shown in FIGS. 1–4. Vacuum cleaner 10 has a two-piece clamshell housing made up of upper housing 12 and lower housing 14. Preferably, the upper and lower housings 12 and 14 are constructed of a durable thermoplastic, such as a polycarbonate plastic available from Miles Corporation of Edison, N.J. A user may grip vacuum cleaner 10 by handle 18. Switch 20 is mounted on handle 18 in a position where it may be easily reached by a user's thumb. Power cord 22, which supplies power to vacuum cleaner 10, is attached at the end of handle 18.

Figure 6:
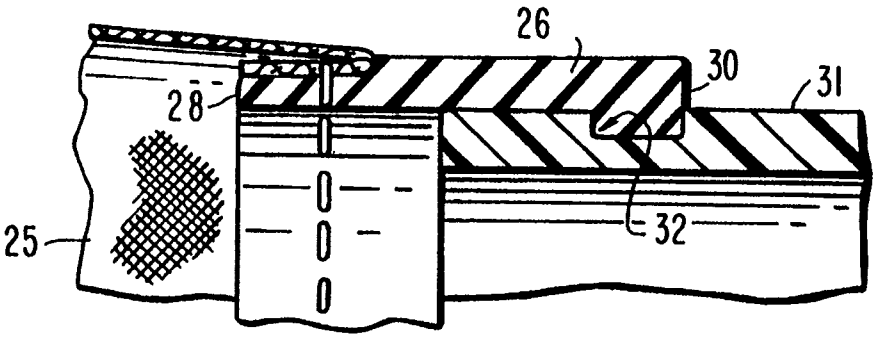
FIG. 6 is a cross-sectional view of a portion of the dirt bag and the housing of the vacuum cleaner of FIG. 1.
Figure 7:
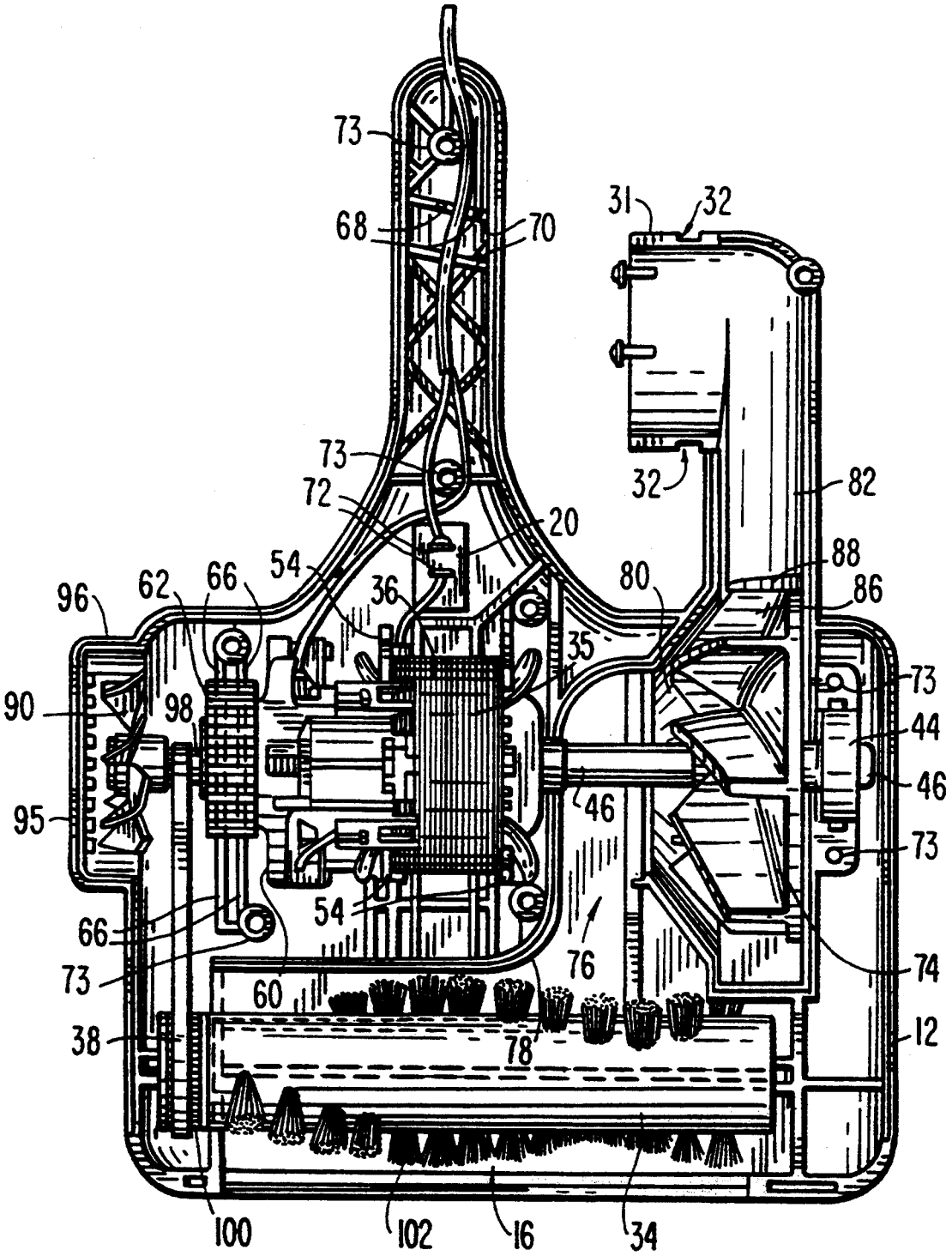
FIG. 7 is a bottom plan view of the vacuum cleaner of FIG. 1 with the lower housing removed.
Figure 13:
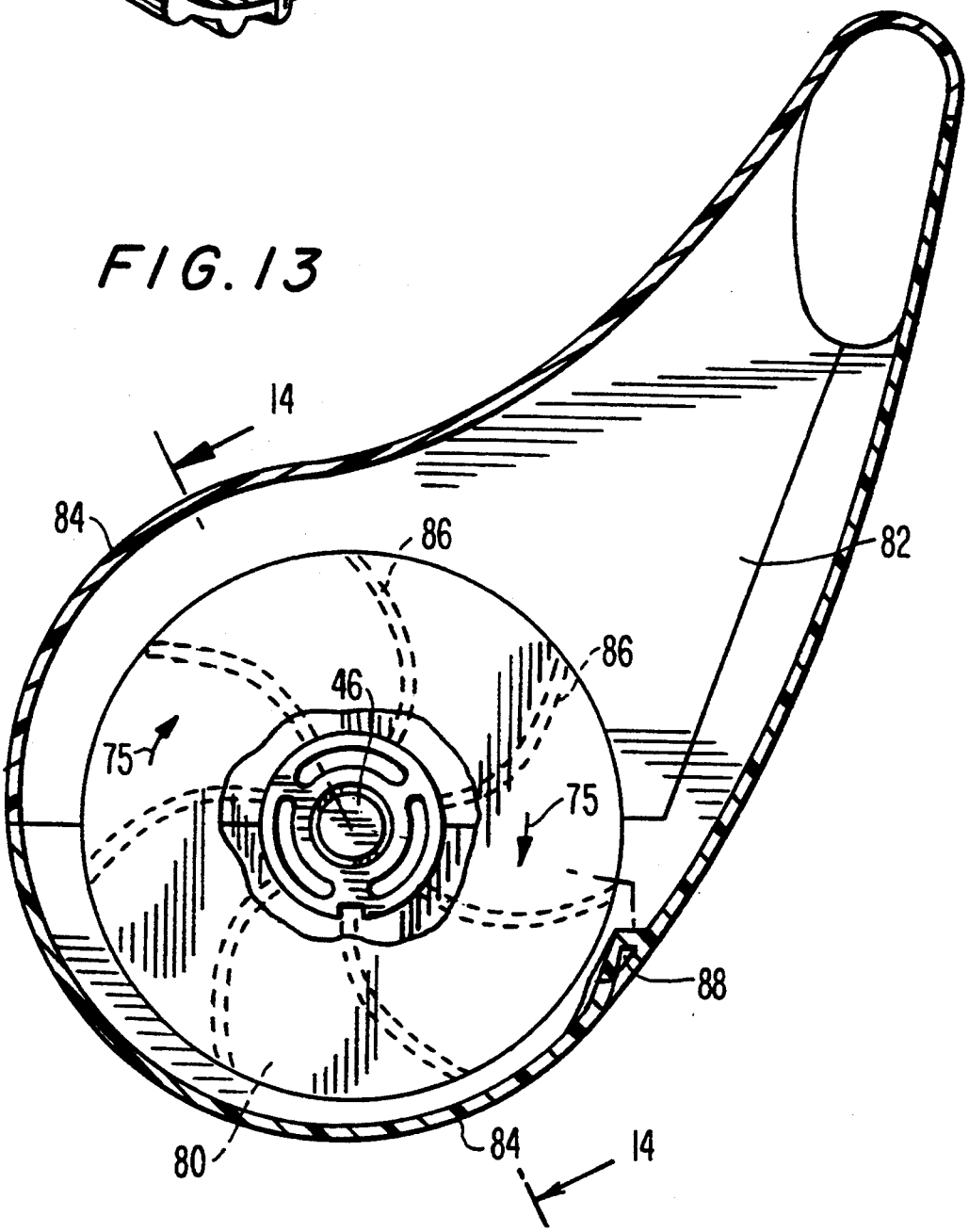
FIG. 13 is an end view, partly in section, of a portion of the vacuum cleaner of FIG. 1 taken along the line 13—13 in FIG. 1, showing the relative position of the suction fan and the exhaust fan chamber walls.

In operation, dirty air is drawn through intake orifice 16 by suction fan 74, which is mounted in suction fan chamber 80. Dirty air passes from the intake orifice into the suction fan chamber 80 (FIGS. 7, 13, and 14). The suction fan chamber 80 encompasses the area defined by the sweep of suction fan 74, including conically shaped suction fan chamber walls 81 (FIGS. 1, 3, 4, 7, 10, 11, and 14). From the suction fan chamber 80, the dirty air is passed into an exhaust chamber 82 (FIGS. 7, 13, and 14), which is adjacent to the suction fan chamber 80, but not within the sweep of the blades of the suction fan 74. Any dirt present in the air is collected in dirt bag 24 (shown in FIGS. 1 and 4–6), which is mounted to cylindrical flange 31 (FIGS. 7, 10, and 11) on upper and lower housings 12 and 14 with elastomeric ring 26. The dirt that collects in dirt bag 24 can be emptied by removing the dirt bag 24 from the housing. Additionally, or alternatively, dirt bag 24 can be provided with a zipper, so that dirt bag 24 can be emptied without removing the dirt bag 24 from the housing. Other dirt collection arrangements are also possible. For example, a porous cup is a suitable alternative dust container.

Figure 5:
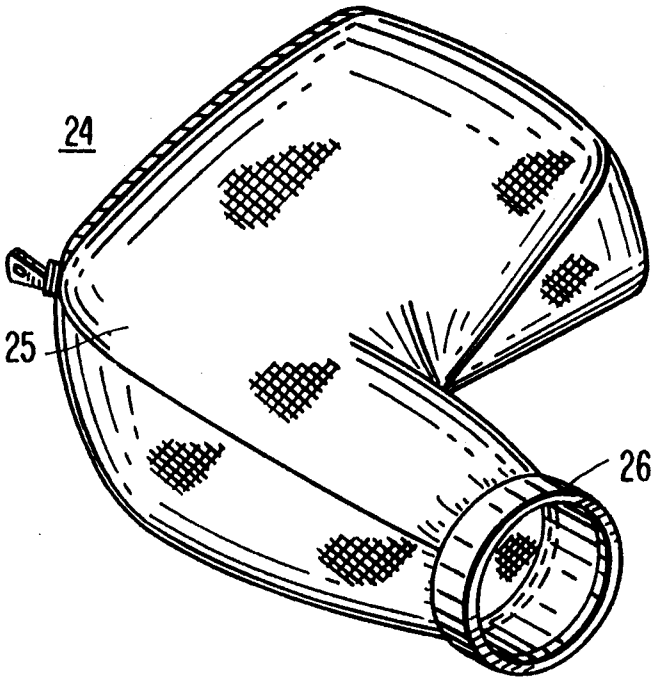
FIG. 5 is a perspective view of a preferred embodiment of a dirt bag in accordance with the present invention.

Preferably, dirt bag 24 is comprised of a filtration material, such as the C138 or C143 filtration material, sold under the trademark "TIETEX", and available from Tietex Corporation of Spartanburg, S.C. Elastomeric ring 26 is preferably comprised of a thermoplastic rubber having a hardness of 45–50 durometer Shore A scale. As shown in FIGS. 5 and 6, the fabric 25 of dirt bag 24 is preferably sewn to elastomeric ring 26 on the outside of thin extension 28, preferably using a lock stitch. The fabric 25 is folded over to cover the stitches. Wide bead 30 of elastomeric ring 26 engages and seats in groove 32 in cylindrical flange 31 on upper and lower housings 12 and 14.

As shown in FIG. 7, brush 34 is mounted to vacuum cleaner 10 adjacent to intake orifice 16. Preferably, brush 34 has a polypropylene brush dowel with a steel shaft and two acetal end caps. Brush 34 may be coupled to motor 36 using any convenient means for transferring the rotational motion of motor 36 to brush 34, such as gears, belts, toothed belts, or any other means of transferring rotational motion known in the art. Preferably, brush 34 is coupled to motor 36 using toothed elastomeric belt 38. In a preferred embodiment, toothed elastomeric belt 38 is a fiber-reinforced HTD-type belt having 69 teeth along its inside with a 3 mm pitch, available from Gates Rubber Corporation of Denver, Colo. Because belt 38 has teeth, it is less likely to slip than a conventional toothless belt. Further, because motor 36 is axially parallel to brush 34, it is not necessary to twist belt 38, which reduces belt wear and reduces the required spacing between brush 34 and motor 36, making vacuum cleaner 10 more compact. Preferably, motor 36 is a conventional series-wound AC motor.

Figure 8:
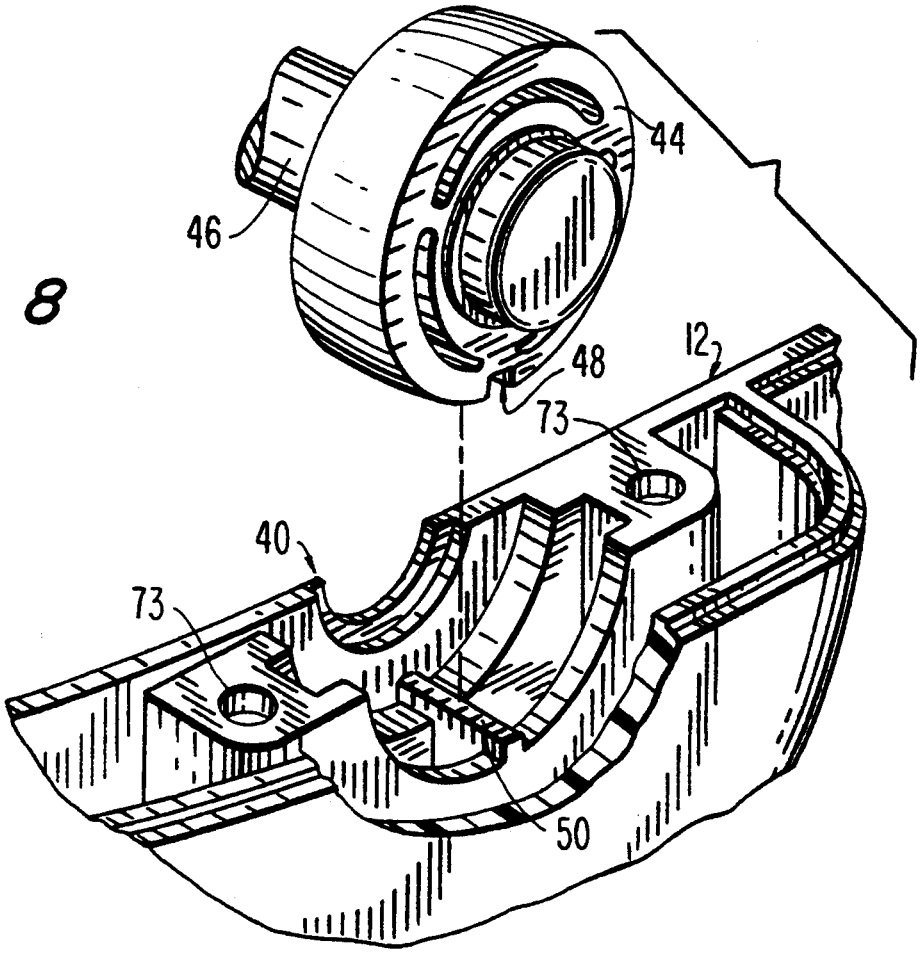
FIG. 8 is an exploded perspective view of a portion of the upper housing of the vacuum cleaner of FIG. 1 with a portion cut away, showing the placement of a motor bearing in the upper housing in accordance with the one aspect of present invention.
Figure 9:
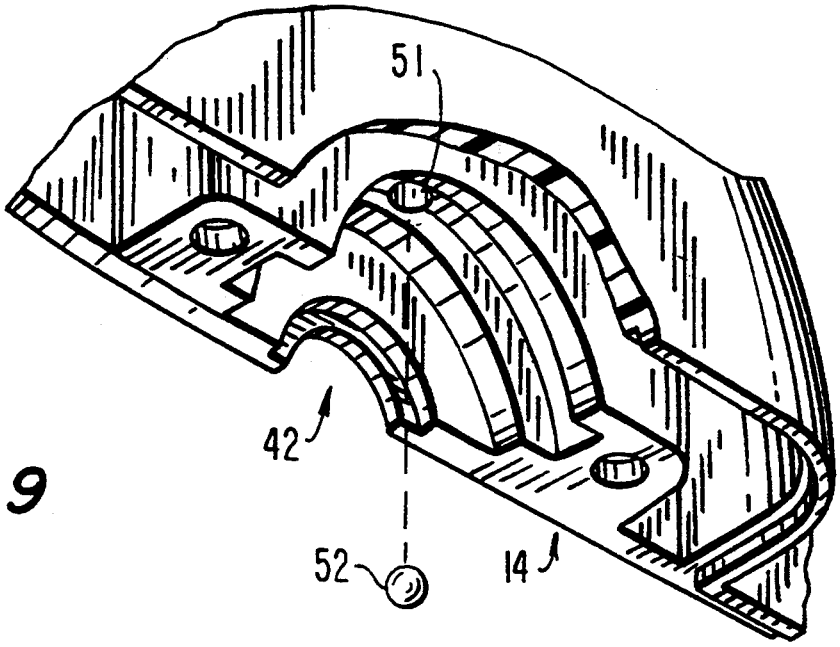
FIG. 9 is a perspective view with a portion cut away of a portion of the lower housing of the vacuum cleaner of FIG. 1 that mates with the portion of the upper housing shown in FIG. 8.

Upper and lower housings 12 and 14 have integrally formed recesses and support members that allow the components of motor 36 to be mounted directly to the housing. As shown in FIGS. 8 and 9, upper and lower housings 12 and 14 have semi-circular portions 40 and 42, respectively, which engage bearing 44 and therefore support motor shaft 46. Bearing 44 has a shallow axially-extending slot 48, which engages ridge 50 on upper housing 12. During the operation of vacuum cleaner 10, slot 48 and ridge 50 prevent bearing 44 from rotating about the rotational axis of motor shaft 46. Semicircular portion 42 of lower housing 14 has a cylindrical indentation 51 in which elastomeric ball 52 is placed. Preferably the elastomeric ball 52 is formed from a high-temperature fluoroelastomer such as that sold under the trademark "VITON", available from Dupont Corporation of Wilmington, Del. When the upper and lower housings 12 and 14 are mounted together, elastomeric ball 52 is compressed, which forces bearing 44 toward semi-circular portion 40 in upper housing 12. Conventional washers or retainer clips (not shown) prevent relative axial motion between motor shaft 46 and bearing 44. Preferably, bearing 44 is a vented spherical sleeve bearing made of sintered bronze.

Figure 10:
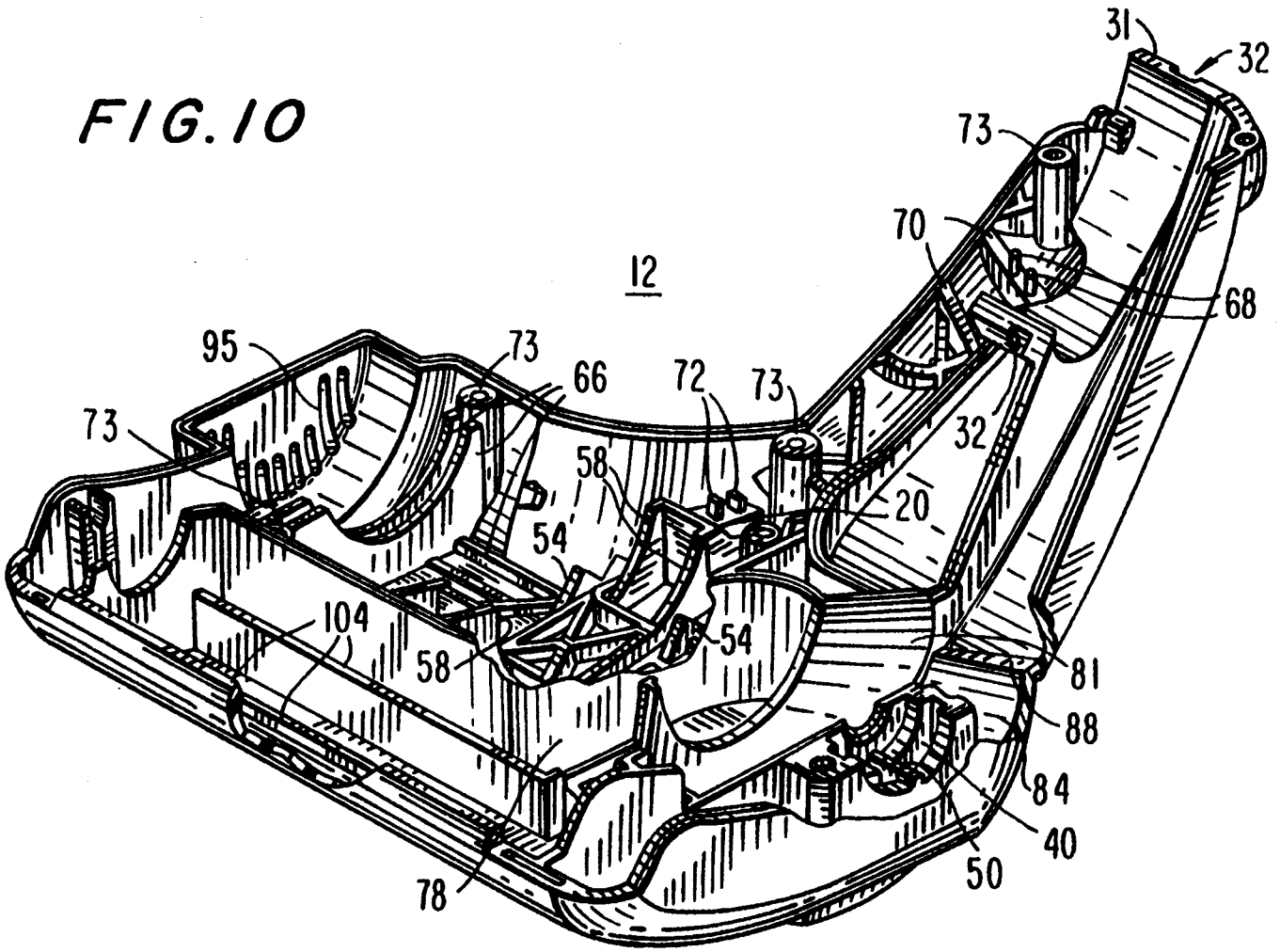
FIG. 10 is a perspective view of the interior of the upper housing of the vacuum cleaner of FIG. 1 with a portion cut away.
Figure 11:
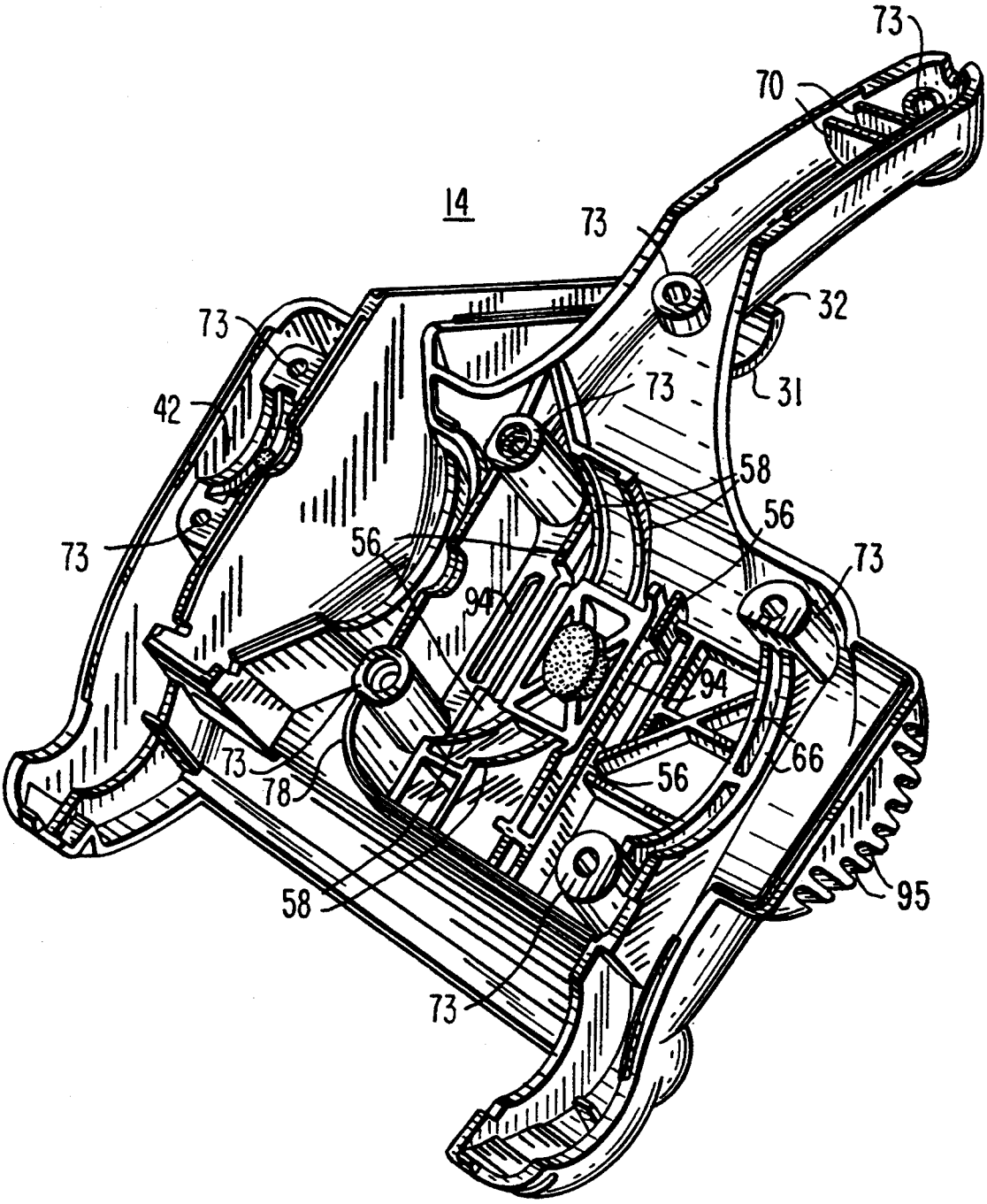
FIG. 11 is a perspective view of the interior of the lower housing of the vacuum cleaner of FIG. 1.
Figure 12:
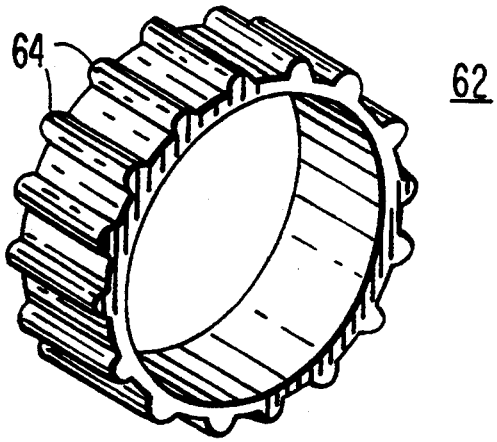
FIG. 12 is a perspective view of a preferred embodiment of a motor mounting ring, which is preferably a component of the vacuum cleaner of FIG. 1.

Integrally formed portions of upper and lower housings 12 and 14 also support the stator 35 of motor 36. When the upper and lower housings 12 and 14 are mated together, the stator of motor 36 is prevented from moving along its axis by axially supporting ribs 54 on upper housing 12 and axially supporting ribs 56 on lower housing 14, which are shown in FIGS. 7, 10, and 11. Curved stator support ribs 58 (FIGS. 10 and 11) fit around the body of the stator to further prevent motor 36 from moving. To further secure the motor 36, motor end bell 60 is mounted to housings 12 and 14 using motor mounting ring 62 (FIGS. 7 and 12).

Preferably, motor mounting ring 62 is constructed from an elastomeric material. Motor mounting ring 62 has raised ribs 64, which are preferably evenly spaced around the circumference of ring 62 (shown in FIG. 12). As shown in FIG. 7, motor mounting ring 62 fits snugly around the cylindrical surface of motor end bell 60. The motor end bell 60 is attached to the stator and contains one of the motor shaft bearings. The motor end bell 60 and motor mounting ring 62 are held in place securely between the upper housing 12 and the lower housing 14 by semicircular motor mounting ribs 66 (also shown in FIGS. 11 and 12). The raised ribs 64 (FIG. 12) provide motor mounting ring 62 with more radial flex than an equivalent solid ring. As a result, greater variations in the size of the motor mounting ring 62 and the sizes of motor end bell 60 and motor mounting ribs 66 can be tolerated, while still securely mounting the motor 36 in place in the housing. Preferably, motor mounting ring 62 is made of an elastomer formed from an ethylene propylene diene monomer, commonly known as EPDM. It will be appreciated by those skilled in the art that, while the use of the motor mounting ring 62 has been illustrated in the context of handheld vacuum cleaners, the present invention is not so limited, and the motor mounting ring 62 could be used in other types of vacuum cleaners as well, such as upright or canister vacuum cleaners.

In addition to holding motor 36 securely in place in the housing, upper and lower housings 12 and 14 are used to secure power cord 22. When upper and lower housings 12 and 14 are mated, posts 68 and rib bars 70 (FIGS. 10 and 11) hold power cord 22 firmly in place, so that, even in the event power cord 22 is accidentally pulled, internal electrical wires will not be placed under tension. In order to simplify the process of assembling the vacuum cleaner 10, terminals 72 on switch 20 (FIGS. 7 and 10) are used to make electrical connections between motor 36 and power cord 22. The upper and lower housings 12 and 14 are preferably held together with screws, which engage conventional screw bosses 73 (FIGS. 7–11).

In operation, suction is produced by suction fan 74, which is shown in FIG. 7. In a preferred embodiment, suction fan 74 is constructed from a high-impact nylon, available from Dupont. Corporation of Wilmington, Del. Suction fan 74 is preferably press-fit onto motor shaft 46 in a manner well-known in the art. When rotating in direction 75 (shown in FIG. 13), fan 74 creates a flow of air that draws dirt through intake orifice 16 and through entrance chamber 76. The motor 36 is isolated from entrance chamber 76 by wall 78, portions of which extend from upper housing 12 and lower housing 14. Dirt-laden air passes through fan chamber 80 and exhaust chamber 82. The dirt-laden air passes through the inside of cylindrical flange 31 and into dirt bag 24.

As shown in FIG. 13, exhaust chamber wall 84 surrounds exhaust chamber 82. Exhaust chamber wall 84 spirals outwardly, so that the separation between the tips of fan blades 86 and spiral-shaped exhaust chamber wall 84 gradually increases as fan blades 86 rotate about the rotational axis of motor shaft 46 in direction 75. Tongue 88 is located at the point where the tips of fan blades 86 are closest to chamber wall 84.

In accordance with the present invention, tongue 88 and the tips of fan blades 86 are angled with respect to one another. Preferably, tongue 88 forms angles with respect to both horizontal and vertical planes, as illustrated in FIGS. 7, 10, 13, and 14. The portions of the tips of fan blades 86 that pass by tongue 88 are substantially horizontal (i.e. parallel to the axis of rotation of motor shaft 46), whereas tongue 88 is sloped downward from left to right, as best shown in FIG. 14. As a result., when the tips of the suction fan blades 86 pass tongue 88, the air between the tips of the suction fan blades 86 and the tongue is compressed less forcefully than it would be if tongue 88 were horizontal (or parallel to the tips of fan blades 86). Because air compression by the suction fan blades 86 generates noise, angling the tongue 88 with respect to the tips of the suction fan blades 86 reduces the noise generated by the suction fan 74. This effect may be obtained by any configuration which relatively angles the tips of fan blades 86 with respect to tongue 88.

The angle of tongue 88 and the spiral shape of exhaust chamber wall 84 create a smooth interface between fan chamber 80 and exhaust chamber 82, which not only reduces noise, but also increases suction efficiency. After passing through exhaust chamber 82, air enters dirt bag 24 via the upper part of exhaust chamber 82 defined by cylindrical flange 31 (FIG. 1). If desired, a conventional flap valve (not shown) may be placed across the exit of exhaust chamber 82, to prevent objects in dirt bag 24 from accidentally being introduced into exhaust chamber 82.

As shown in FIG. 7, cooling fan 90 is mounted to motor shaft 46 adjacent to motor 36. Because cooling fan 90 is mounted directly to shaft 46, it is not necessary to use a belt to drive cooling fan 90. The vacuum cleaner 10 can also be made more compact because the bearing secured in motor end bell 60 is positioned between cooling fan 90 and motor 36. Upper and lower housings 12 and 14 have portions defining cooling air intake slots 94 though which cooling air is drawn and cooling air outlet slots 95 through which the cooling air is exhausted. In a preferred embodiment cooling air intake slots 94 have recessed cover louvers as are well-known in the art, which direct cooling air toward the motor, and which prevent, foreign objects from being inadvertently introduced into the housing in the vicinity of the motor. The cooling air that is supplied to the motor 36 is directed past the commutator brushes of motor 36 and the motor coil windings.

Cooling air is also supplied to the bearing mounted in motor end bell 60. Because the air passageway around the bearing that is mounted in end bell 60 is fairly small, motor mounting ribs 66 do not extend to the plane in which the upper housing 12 joins the lower housing 14, thus, there is a gap between the semicircular motor mounting ribs 66 on upper housing 12 and the semicircular motor mounting ribs 66 on lower housing 14. When the upper and lower housings 12 and 14 are joined, the semicircular motor mounting ribs 66 do not meet. Rather, the semicircular motor mounting ribs 66 remained separated by a horizontal gap, which allows cooling air to flow freely from the vicinity of the motor 36, past the bearing mounted in the motor end bell 60, to the area surrounding the cooling fan 90. If the semicircular motor mounting ribs 66 from the upper and lower housings 12 and 14 met and closed the passageway between the motor 36 and the cooling fan 90, cooling air would be forced to flow through the relatively small passageway between the motor end bell 60 and the bearing mounted in the end bell 60. Although such an airflow would cool the bearing, without providing an additional path for the cooling air through the gap, the small passageway in the motor end bell 60 would create a back-pressure in the vicinity of the motor 36, which would restrict the supply of cooling air to the motor 36. In the vicinity of cooling fan 90, upper and lower housings 12 and 14 are shaped to form shroud 96, which is required for cooling fan 90 to operate efficiently. By forming shroud 96 as an integral part of upper and lower housing 12 and 14, a compact vacuum cleaner 10 can be constructed economically.

The placement of suction fan 74 between bearing 44 and motor 36 reduces vibrations, because bearing 44 supports the end of motor shaft 46, which prevents the shaft 46 from wobbling as much as would otherwise be the case. Further, placing the bearing 44 on the end of the shaft 46 allows the suction fan 74 to be placed closer to the center of the intake orifice 16, which creates a more efficient airflow through the vacuum cleaner 10.

In the preferred embodiment, pinion 98 is preferably press-fit onto motor shaft 46 between cooling fan 90 and motor 36. Pinion 98 engages toothed belt 38 (also shown in FIG. 15), which in turn engages toothed pulley 100, which is an integral part of brush 34. Brush 34 has two rows of nylon bristles 102 that rotate past deflection ribs 104, shown in FIGS. 2 and 10. Deflection ribs 104 deflect dirt entering intake orifice 16, so that the dirt is caught up in the flow of air through the vacuum cleaner 10, rather than being deflected by bristles 102 back toward intake orifice 16. Specifically, deflection ribs 104 deflect dirt rotating with the brush 34, so that the dirt is reentrained with the flow of air through the vacuum cleaner 10, rather than being carried by the brush 34 and ejected back through the intake orifice 16. Deflection ribs 104 therefore improve the cleaning capability of vacuum cleaner 10. Preferably, deflection ribs 104 are an integral part of upper housing 12.

Figure 2:
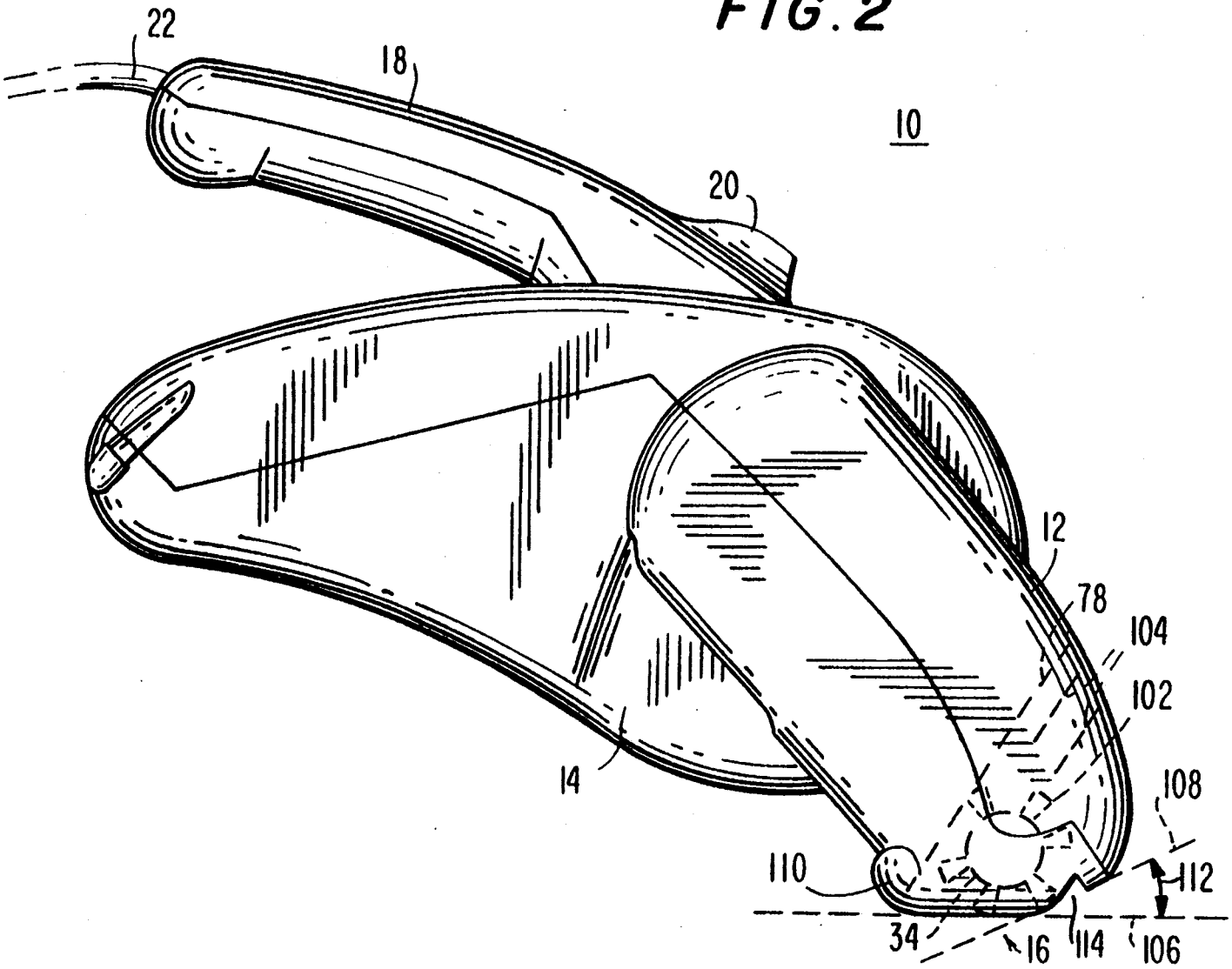
FIG. 2 is a right side elevational view of the vacuum cleaner of FIG. 1 with the dirt bag removed.
Figure 3:
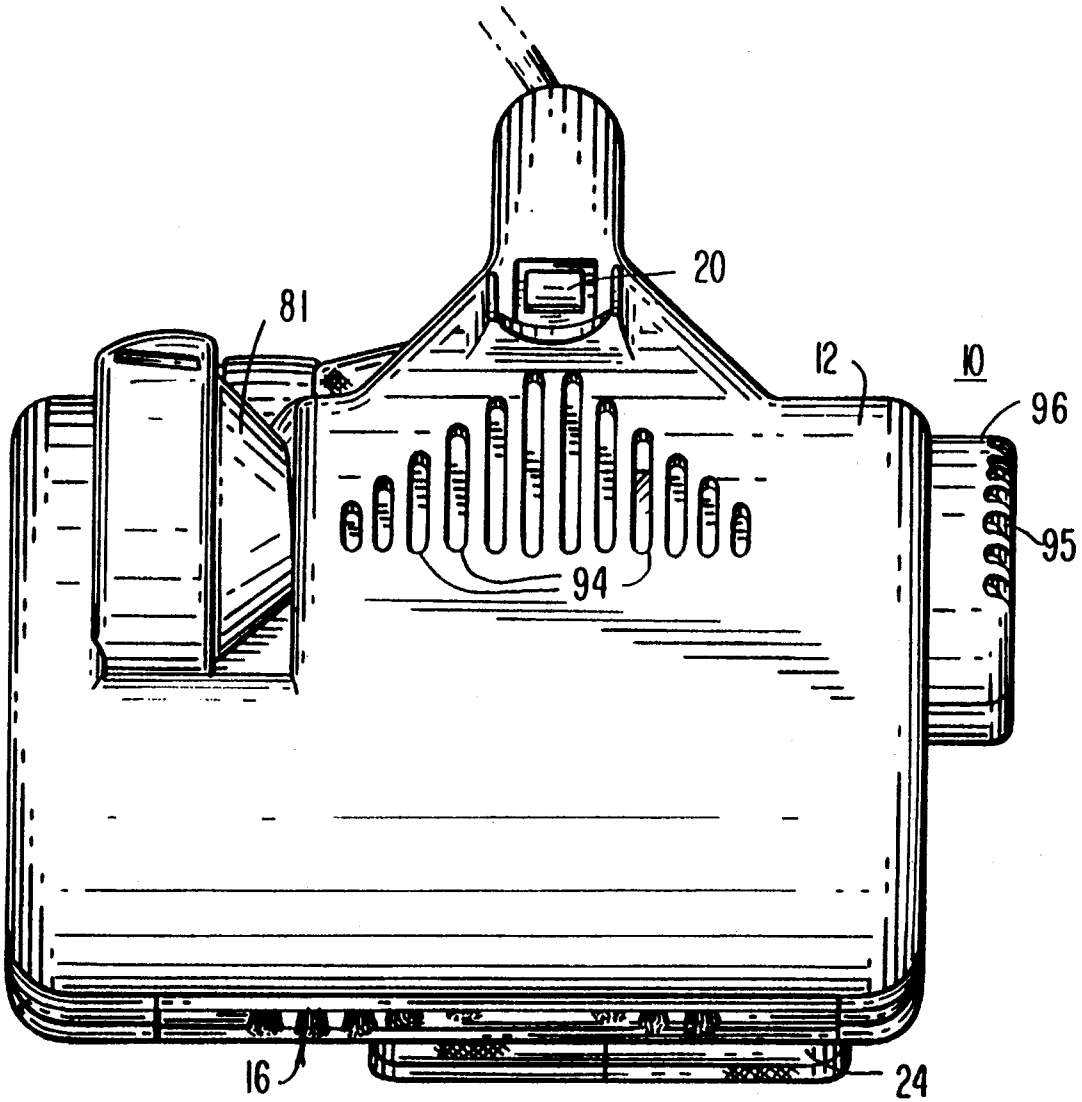
FIG. 3 is a front elevational view of the vacuum cleaner of FIG. 1 with the dirt bag removed.
Figure 4:
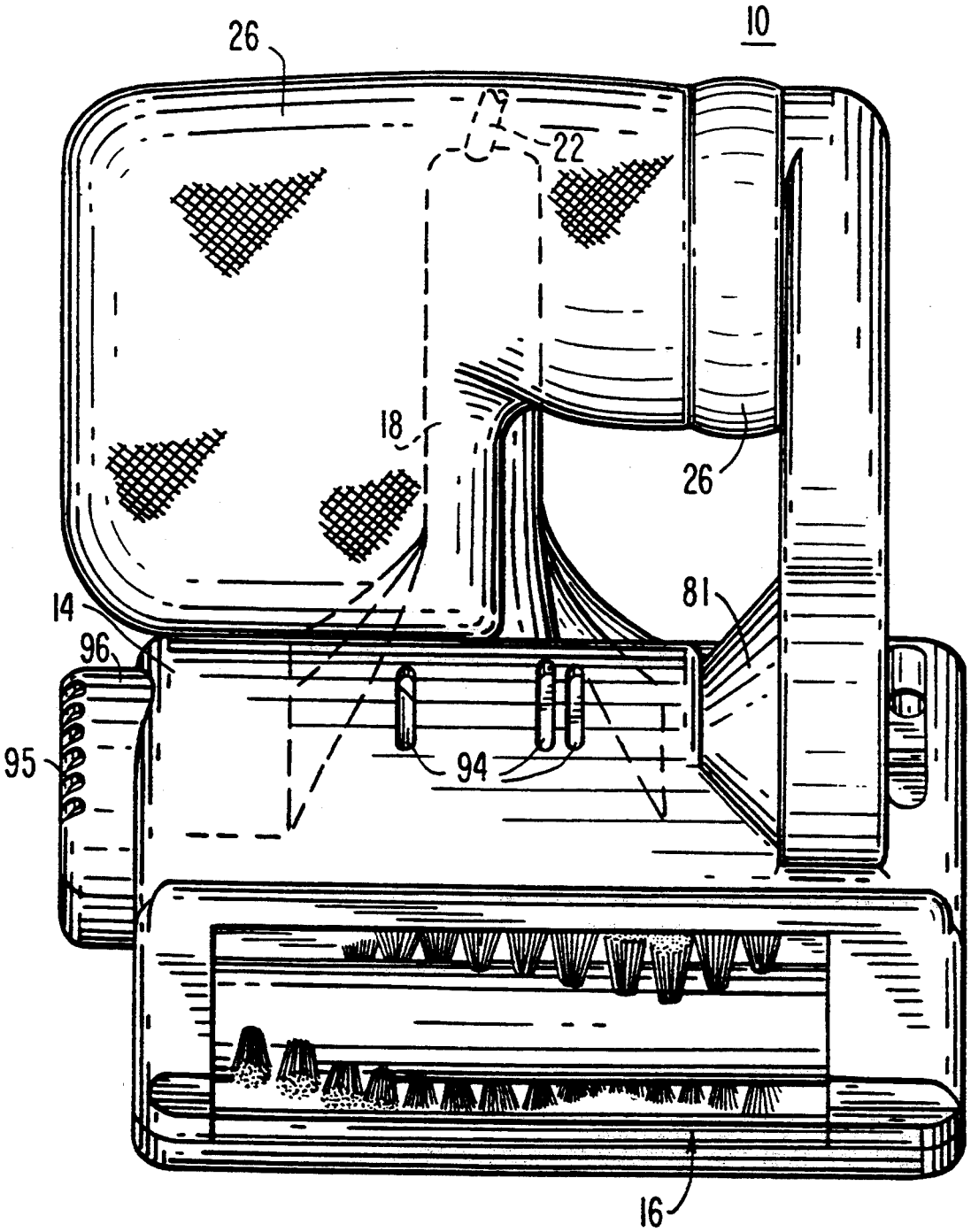
FIG. 4 is a bottom view of the vacuum cleaner of FIG. 1.

As shown in FIG. 2, upper and lower housings 12 and 14 follow two distinct planes in the vicinity of intake orifice 16. At the part of the vacuum cleaner 10 near the rearward side of the intake orifice 16, lower housing 14 follows plane 106. In the front of vacuum cleaner 10, portions of upper and lower housings 12 and 14 follow plane 108. Planes 106 and 108 define two distinct cleaning positions for vacuum cleaner 10 with respect to a flat cleaning surface. As the vacuum cleaner 10 is moved forward, the user may place vacuum cleaner 10 in a position in which plane 106 is aligned with the cleaning surface. On the return stroke, as the vacuum cleaner 10 is moved backward, the user may position vacuum cleaner 10 so that plane 108 is aligned with the cleaning surface. On the forward stroke, air enters the exposed portion of intake orifice 16 parallel to plane 108, while the portion of intake orifice 16 parallel to plane 106 is in contact with the cleaning surface. This arrangement permits a substantial flow of air, which carries dirt from the cleaning surface efficiently. On the backward stroke, the portion of intake orifice 16 parallel to plane 108 is in contact with the cleaning surface, while air enters the portion of intake orifice 16 parallel to plane 106.

One advantage of this design is that the shape of intake orifice 16 allows one to clean immediately adjacent to a vertical wall. With vacuum cleaner 10 in the position in which plane 106 is in contact with the cleaning surface, the portion of intake orifice 16 parallel to plane 108 provides suction in the area directly in front of vacuum cleaner 10. In contrast, with many conventional vacuum cleaners a lip contacting the surface being cleaned surrounds the intake, so that when such a cleaner approaches a vertical wall, dirt remains trapped under the lip.

If desired, the user can maintain vacuum cleaner 10 in the position in which the portion of intake orifice 16 parallel to plane 106 is aligned with the cleaning surface for both the forward and backward strokes. In this case, rounded portion 110 of lower housing 14 allows vacuum cleaner 10 to slide over any debris on the cleaning surface during the backward stroke. Preferably, planes 106 and 108 intersect at an acute angle 112 of between 5° and 30°, most preferably angle 112 is approximately 10°. Notch 114 allows air to flow from the sides of vacuum cleaner 10, which enhances the edge cleaning capabilities of vacuum cleaner 10.

Thus, a compact handheld vacuum cleaner is provided. One skilled in the art will appreciate that the present invention can be practiced by other than the described embodiments, which are presented for purposes of illustration and not of limitation. For example, while the principles of the present invention have been illustrated in the context of a handheld vacuum, it will be appreciated by one skilled in the art that the present invention also relates to other types of vacuum cleaners such as upright or canister vacuum cleaners.

What is claimed is:

1. A handheld vacuum cleaner for removing dirt from a cleaning surface, the handheld vacuum cleaner comprising:

a housing having an intake orifice;

a handle connected to the housing, the handle having a longitudinal axis;

a rotating brush having a brush rotational axis and being mounted in the housing adjacent to the intake orifice for dislodging dirt from the cleaning surface as the brush rotates about said brush rotational axis;

a motor having a rotating motor shaft, said rotating motor shaft having a shaft rotational axis, the motor being mounted in the housing such that said shaft rotational axis of the motor shaft is substantially parallel to said brush rotational axis of the brush and substantially perpendicular to the handle;

means for transferring rotational motion from the motor to the rotating brush;

a suction fan chamber in said housing coupled to the intake orifice;

an exhaust chamber in said housing coupled to the suction fan chamber;

a suction fan rotatably mounted in the suction fan chamber, the suction fan being coupled to the motor shaft so that the suction fan is rotated by the motor, the suction fan drawing air through the intake orifice into the suction fan chamber and passing said air into the exhaust chamber, the suction fan having a plurality of suction fan blades and being coupled to the motor shaft so that the suction fan blades rotate with the motor shaft, each suction fan blade having a suction fan blade tip;

a tongue member located between the suction fan chamber and the exhaust chamber, the tongue member being adjacent to the suction fan blades and being angled at a non-zero angle with respect to the suction fan blade tips; and dirt collection means connected to the exhaust chamber for receiving said air from the exhaust chamber and for collecting any dirt present in said air.

2. The handheld vacuum cleaner of claim 1, wherein the means for transferring rotational motion from the motor to the rotating brush comprises an untwisted belt connected between the motor shaft and the brush, so that when the motor shaft rotates, the belt rotates the brush.

3. The handheld vacuum cleaner of claim 1, wherein the means for transferring rotational motion from the motor to the rotating brush comprises:

a toothed belt;

a pinion on the motor shaft; and teeth disposed circumferentially on the brush to form a pulley, wherein the toothed belt engages the pinion and the teeth, so that the motor rotates the brush.

4. A vacuum cleaner for removing dirt from a cleaning surface, the vacuum cleaner comprising:

a housing having an intake orifice;

a motor mounted to the housing, the motor having a rotating motor shaft that rotates about a rotational axis;

a suction fan chamber coupled to the intake orifice;

a suction fan rotatably positioned in the suction fan chamber for drawing air through the intake orifice into the suction fan chamber, the suction fan having a plurality of suction fan blades and being coupled to the motor shaft so that the suction fan blades rotate with the motor shaft, each suction fan blade having a suction fan blade tip;

an exhaust chamber coupled to the suction fan chamber for receiving said air;

a tongue member located between the suction fan chamber and the exhaust chamber, the tongue member being adjacent to the suction fan blades and being angled at a non-zero angle with respect to the suction fan blade tips; and dirt collection means connected to the exhaust chamber for collecting any dirt present in said air as said air exits the exhaust chamber.

5. The vacuum cleaner of claim 4, further comprising a cooling fan connected directly to the motor shaft for supplying cooling air to the motor when the motor shaft is rotated.

6. The vacuum cleaner of claim 5, wherein the cooling fan is surrounded by a shroud formed as an integral part of the housing.

7. The vacuum cleaner of claim 4, wherein the exhaust chamber is bounded by a spiral-shaped wall, the spiral-shaped wall having a surface that extends substantially parallel to the rotational axis of the motor, such that the separation between the spiral-shaped wall and the suction fan blade tips gradually increases in the direction of rotation of the suction fan around the rotational axis of the motor shaft.

8. The vacuum cleaner of claim 4, further comprising:

a rotating brush mounted to the housing adjacent to the intake orifice for dislodging dirt from the cleaning surface as the brush rotates; and means for transferring rotational motion from the rotating motor shaft to the rotating brush, the means for transferring rotational motion being coupled between the rotating brush and the rotating motor shaft.

9. The vacuum cleaner of claim 4 further comprising:

a toothed belt:

a pinion mounted on the motor shaft; and teeth disposed circumferentially on the brush to form a pulley, wherein the toothed belt engages the pinion and the pulley, so that the motor can rotate the brush.

10. The vacuum cleaner of claim 4, wherein the motor further comprises a partially cylindrical end bell, the cylindrical portion of the end bell being axially aligned with the rotational axis of the motor shaft, wherein the housing has at least one motor mounting rib that lies in a plane substantially perpendicular to the rotational axis of the motor shaft, and further comprising an elastomeric member that fits between the motor mounting rib and the end bell for securing the motor within the housing, wherein the surface of the elastomeric member has a plurality of raised elastomeric ribs that extend substantially parallel to the rotational axis of the motor shaft, the raised elastomeric ribs being compressed between the motor mounting rib and the end bell.

11. The vacuum cleaner of claim 4, further comprising:

a bearing for supporting the motor shaft, the bearing having a slot; and a ridge formed as an integral part of the housing, the ridge mating with the slot to prevent rotation of the bearing with respect to the housing.

12. The vacuum cleaner of claim 4, wherein the housing has an improved intake orifice defined by a front wall, a rear wall, and side walls, the side walls having front and rear portions, wherein the underside of the front wall and the undersides of the front portions of the sides walls lie substantially in a first plane and the underside of the rear wall and the underside of the rear portions of the side walls lie substantially in a second plane which intersects the first plane.

13. The vacuum cleaner of claim 4, further comprising at least one deflection rib disposed adjacent to the brush, the deflection rib deflecting any dirt entering the intake orifice, so that such dirt is caught up in said air drawn into the suction fan chamber, rather than being deflected back toward the intake orifice.

* * * * *

UNITED STATES PATENT AND TRADEMARK OFFICE

CERTIFICATE OF CORRECTION

PATENT NO. : 5,448,794

DATED : September 12, 1995

INVENTOR(S) : John W. Walch et al.

It is certified that error appears in the above-indentified patent and that said Letters Patent is hereby corrected as shown below:

Column 3, line 36, ".angled" should be -- angled --;
line 44, after "of" should be inserted -- the --.

Column 4, line 10, after "of" should be inserted -- the --.

Column 6, line 48, "Dupont." should be -- "Dupont" --.

Column 7, line 7, "result.," should be -- result, --;
line 38, "though" should be -- through --.

Column 8, line 10, "housing" should be -- housings --.

Claim 10, line 64, "4" should be -- 4, --.

Signed and Sealed this

Fifth Day of August, 1997

Bruce Lehman

*Attest:*

BRUCE LEHMAN

*Attesting Officer*

*Commissioner of Patents and Trademarks*